United States Patent [19]

Wieting

[11] Patent Number: 4,957,201

[45] Date of Patent: Sep. 18, 1990

[54] SHIPPING CARTON AND FOLDING TABLES

[76] Inventor: Clifford E. Wieting, P.O. Box 32480, Louisville, Ky. 40232

[21] Appl. No.: 478,533

[22] Filed: Feb. 12, 1990

[51] Int. Cl.[5] ..... B65D 85/00

[52] U.S. Cl. ..... 206/326

[58] Field of Search ..... 206/326

[56] References Cited

U.S. PATENT DOCUMENTS

| | | | |
|---|---|---|---|
| 2,418,731 | 4/1947 | Seitz | 206/326 X |
| 3,669,252 | 6/1972 | Evans | 206/326 |
| 3,992,849 | 11/1976 | Lett, III | 206/326 X |

*Primary Examiner*—William I. Price

*Attorney, Agent, or Firm*—Charles G. Lamb

[57] ABSTRACT

A shipping carton including a plurality of foldable tables having detachable table tops, each table top being attachable to a support base including two pair of pivotably connected legs. The carton receives the table tops in bottom-to-top relationship vertically oriented so that they are parallel to the side walls of the enclosure. The carton also receives a like number of support bases having the two pair of legs in a closed position one-half of the bases arranged in a side-by-side first stack between one side of the vertical stack of table tops and a first side wall of the carton, and the other half of the bases arranged in a side-by-side second stack between the opposite side of the vertical stack of table tops and the opposite side wall of the container from the frist side wall whereby the stack of table tops are tightly sandwiched therebetween.

11 Claims, 4 Drawing Sheets

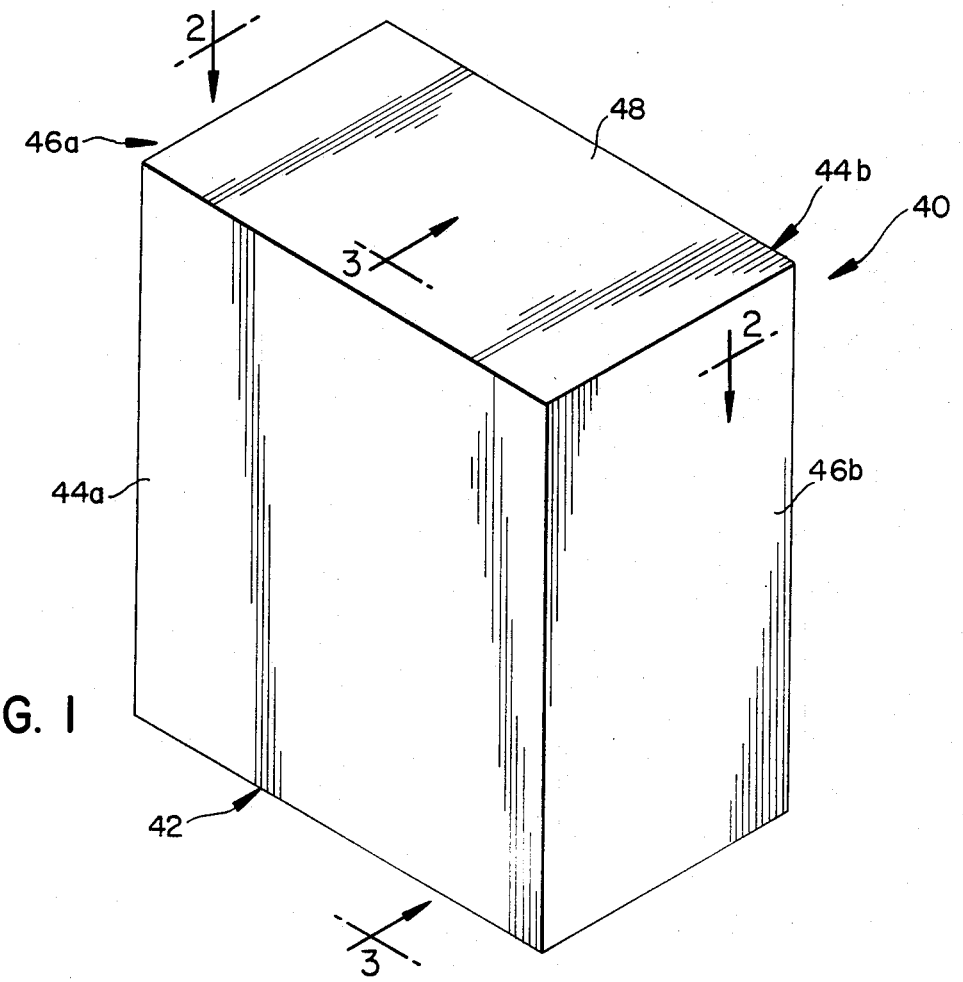
FIG. 1
FIG. 2
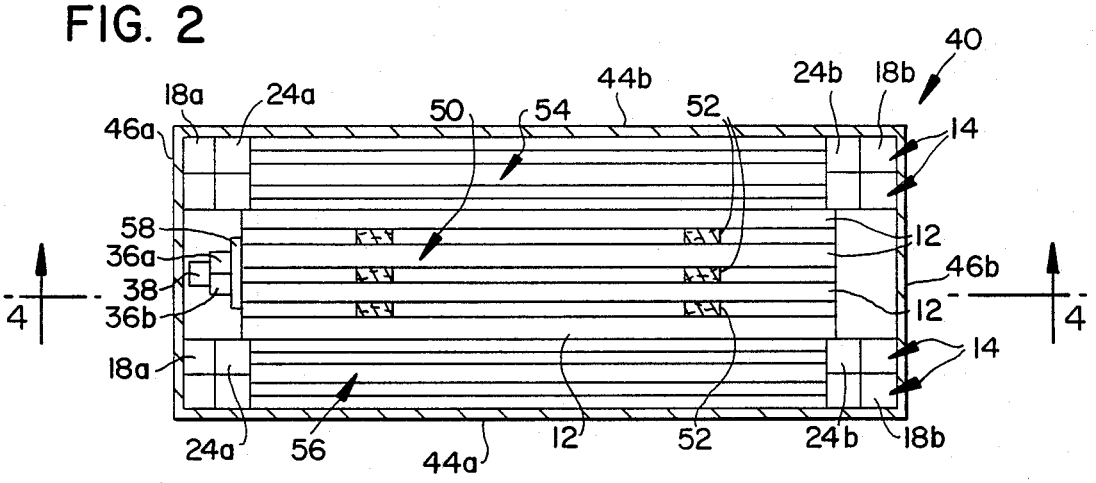

SHIPPING CARTON AND FOLDING TABLES

BACKGROUND OF THE INVENTION

1. Field of the Invention.

The present invention relates to package for articles, and more particularly to shipping cartons including a plurality of folding type tables therein.

2. Description of the Prior Art.

Shipping cartons for a plurality of folding type tables are per se known. However, this heretofore known shipping cartons are bulky, and had a lot of unused space therein. Because of the excessive size, transportation costs have become significant in the overall cost of shipping a set of tables over long distances. Furthermore, in the packing of folding tables for shipment, table tops remain attached to leg supports and generally fold down with the longest dimension transversing the hingedly connected legs.

SUMMARY OF THE INVENTION

The present invention recognizes the drawbacks of the heretofore shipping carton and arrangement of folding tables therein by providing a shipping carton which holds the same number of the same size of folding tables as the heretofore known shipping cartons, but is of substantially less volume, for example, prior art shipping carts are about 2.8 cubic feet in volume whereas the present invention takes up only about 1.9 cubic feet. More particularly, the present invention provides in a shipping carton including a plurality of folding tables therein, the folding tables having table tops and leg support means, the table tops having a length greater than their width, each leg support means including two pairs of pivotally connected legs, an improvement comprising table tops detached from said leg support means, said table tops being oriented with their length dimension vertically disposed in the carton and sandwiched between at least two leg support means, the length dimension of said table tops being in parallel with said pair of legs.

BRIEF DESCRIPTION OF THE DRAWINGS

A better understanding of the present invention will be had upon reference to the following description in conjunction with the accompanying drawings wherein like numerals refer to like parts throughout the views and wherein:

FIG. 1 is a perspective view of the shipping carton of the present invention;

FIG. 2 is a top view of the carton with the top removed, to show internal details;

DETAILED DESCRIPTION OF THE PREFERRED EMBODIMENT

Figure 5:
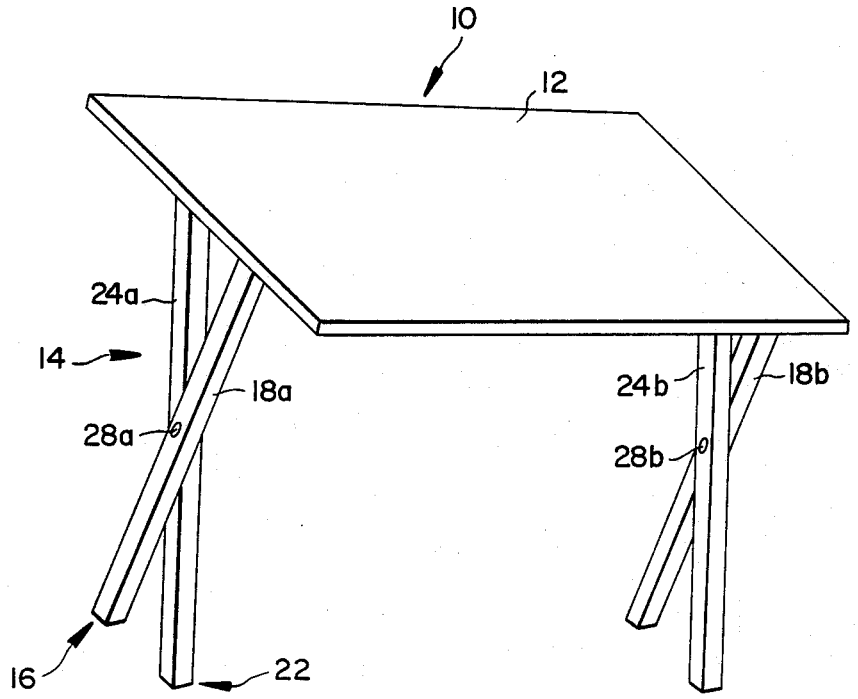
FIG. 5 is a perspective view of an assembled table of the type to be contained in the carton.
Figure 6:
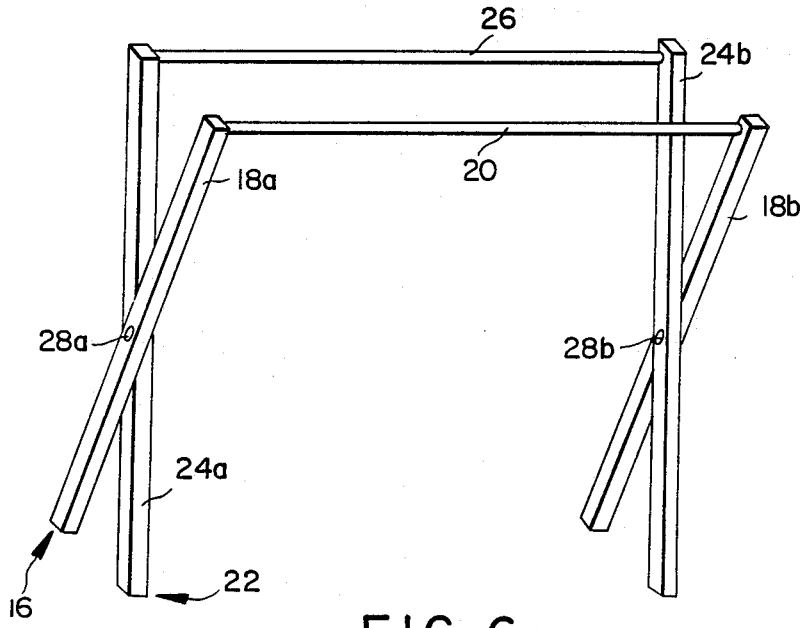
FIG. 6 is a perspective view of a table or support base in the unfolded or open position.
Figure 7:
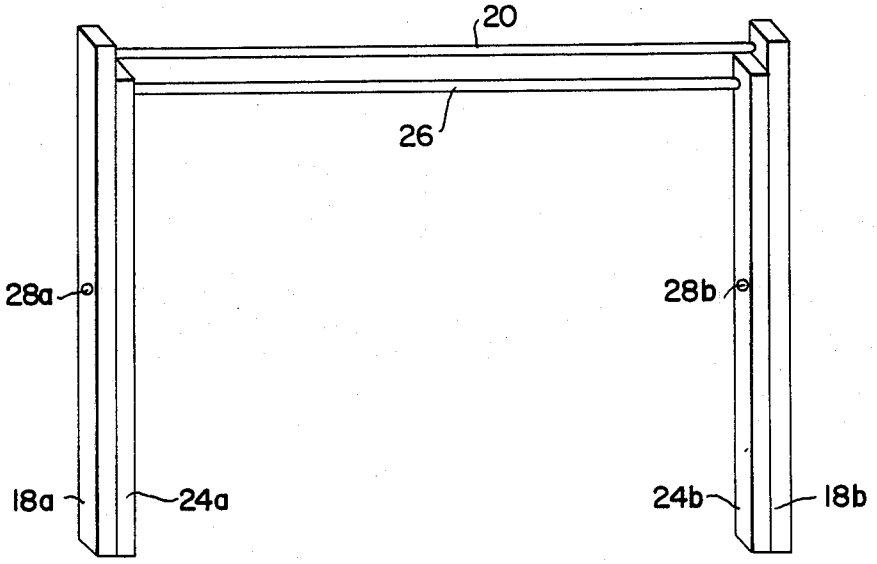
FIG. 7 is a front view of the table base of FIG. 6 in the folded or closed position; and, FIG. 8 is a perspective view of a plurality of the tables mounted in a table storage stand.

With reference to FIGS. 5, 6, and 7, there is shown a conventional folding table, generally denoted as the numeral 10. The table 10 includes a table top 12 which is removably connected to a table top support 14.

The table top 12 has a length dimension greater than a width dimension. As shown, the table top 12 is rectangular in peripheral configuration, but it could be of other shapes, which have a length dimension greater than a width dimension such as, for example, oval.

The table top support 14 is formed of a first pair 16 of spaced apart parallel legs 18A and 18B interconnected by a transverse cross-member 20 interconnecting the top ends of the legs 18A and 18B, and a second pair 22 of spaced apart parallel legs 24A and 24B interconnected by a transverse cross-member 26 interconnecting the top ends of the legs 24A and 24B. Each one of the legs 18A, 18B of the first pair 16 of legs is pivotably attached to a different one of the legs 24A, 24B of the second pair 22 of legs between the top and bottom ends of the legs. As shown, leg 18A of the first leg pair 16 is pivotably connected by pivot 28A to leg 24A of the second leg pair 22, and leg 18B of the first leg pair 16 is pivotably connected by pivot 28B to leg 24B of the second leg pair 22. Therefore, the first leg pair 16 and second leg pair 22 are pivotably moveable relative to each other about the pivots 28A, 28B between the open position shown in FIG. 6 whereat each leg 18A, 18B of the first pair 16 is crossed with the leg 24A, 24B of the second pair 22 to which it is pivotably attached, and the closed position shown in FIG. 7 whereat each leg 18A, 18B of the first pair 16 is in parallel adjacent disposition with the leg 24A, 24B of the second pair 22 to which it is pivotably attached.

Figure 8:
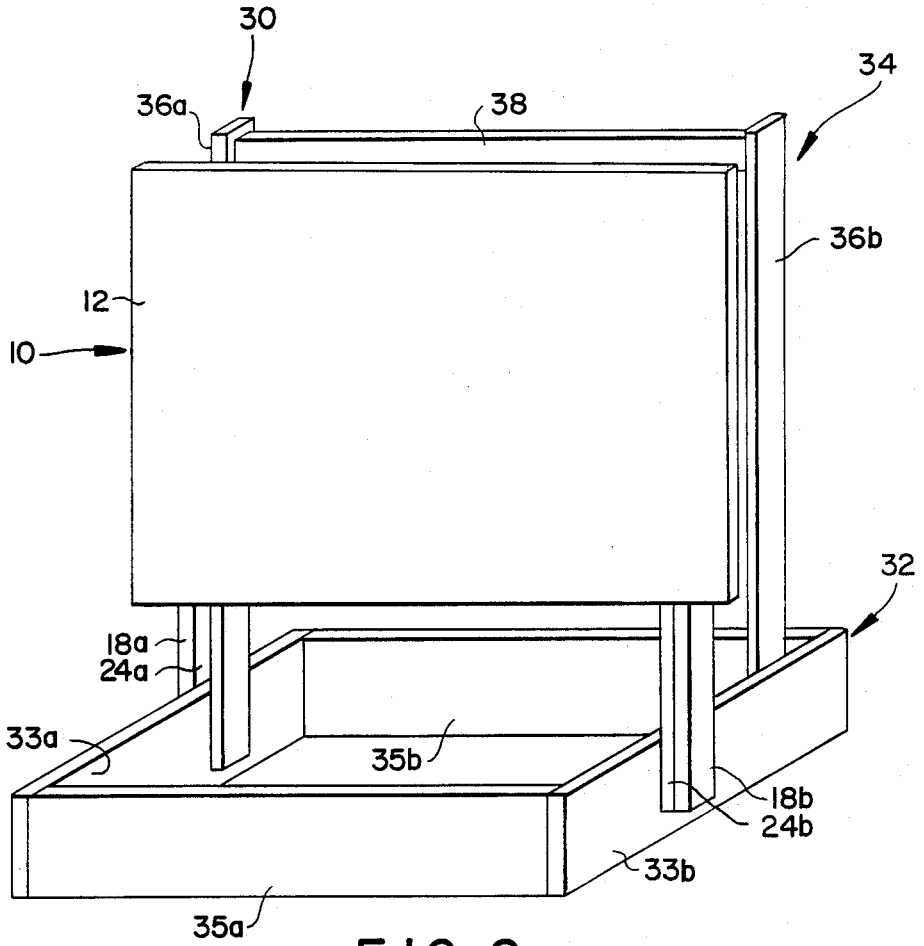

As shown in FIG. 8, a plurality of folding tables 10 in the closed position can be stored in a storage stand 30. The storage stand 30 includes a bottom table leg support frame 32 and a handle frame structure 34 attached to the support frame 32 and extending vertically upwardly therefrom. The table leg support frame 32 engages the bottom ends of the legs 18A, 18B, 24A, 24B of the closed table top support 14 and retaining the table top support 14 with the legs 18A, 18B, 24A, 24B in an upright or vertical side-by-side position. The bottom table leg support frame 32 includes two parallel, spaced apart table leg engaging panels 33A, 33B which engage and retain the bottom ends of the table legs 18A, 18B, 24A, 24B and two transverse brace members 35A and 35B spanning the space between the parallel leg engaging panels 33A and 33B. Each brace member 35A and 35B is attached at one end to one leg engaging panel 33A and at the other end to the other leg engaging panel 33B. The brace members 35A and 35B are attached to the leg engaging members 33A and 33B by screws (not shown) so that the bottom table leg support frame 32 can be easily disassembled. The handle frame support structure 34 includes two parallel vertical support bars 36A, 36B attached at their bottom ends to the table leg engaging panel 33A, 33B leg support frame 32 and a horizontal transverse handle bar 38 interconnecting the top ends of the vertical support bars 36A, 36B. The vertical support bars 36A, 36B are attached to the leg support frame 32 by screws (not shown) and the handle bar 38 is attached to the vertical support bars 36A, 36B by screws (not shown) so that the handle frame support structure 34 can be easily removed from the storage stand 30 and also so that the transverse handle bar 38 can be easily disassembled from the vertical support bars 36A, 36B.

Now with reference to FIGS. 1–4, there is shown an enclosure 40 for containing a plurality of tables 10 for shipping and storage. The enclosure 40 has a bottom wall 42, two spaced apart side walls 44A and 44B, two spaced apart end walls 46A and 46B and a top wall 48.

Figure 3:
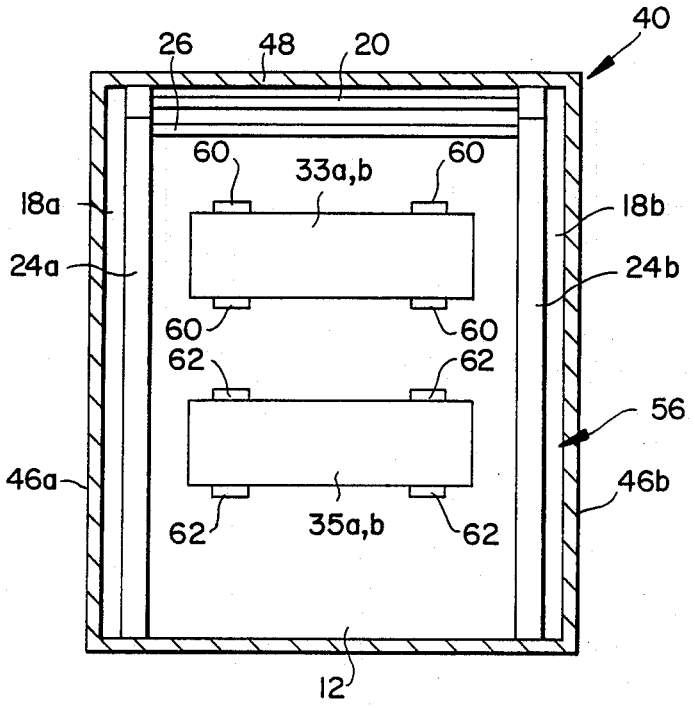
FIG. 3 is a cross-sectional front view of the carton as seen in the direction of arrows 3—3 in FIG. 1 to show internal details.
Figure 4:
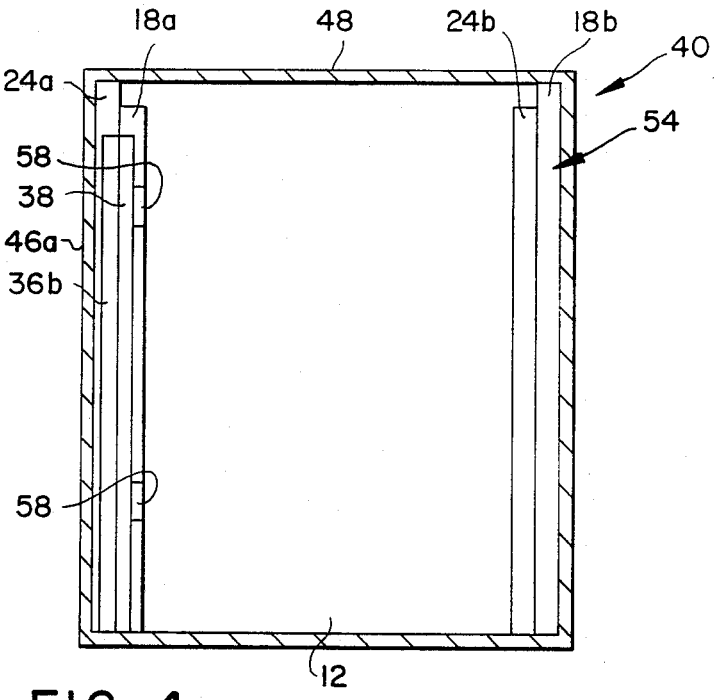
FIG. 4 is a cross-sectional front view of the carton as seen in the direction of arrows 4—4 in FIG. 1 to show material details.

With continued reference to FIGS. 2–4, a stack 50 of table tops 12 consisting of a plurality of table tops, for example, four table tops 12, are disposed in bottom-to-top juxtaposition with resilient material spacers 52 inserted between adjacent table tops 12 to prevent them from contacting each other. The table top stack 50 is located in the enclosure 40 with the length dimension of the tops 12 vertically disposed and parallel with the side walls 44A, 44B of the enclosure 40.

A plurality of closed table top supports 14, for example four table top supports 14, are also disposed in the enclosure 40. One-half of the number of table supports 14, for example two supports 14, are arranged in a side-by-side first stack 54 of supports 14. The first table top supports stack 54 is located in the enclosure 40 to one side of the table top stack 50 between the table top stack 50 and one side wall 44A of the enclosure 40 with the legs 18A, 18B, 24A, 24B parallel to the adjacent enclosure side wall 44A and enclosure end walls 46A, 46B and in contact with the table top stack 50, the adjacent enclosure side wall 44A, both enclosure end walls 46A, 46B, the enclosure bottom wall 42, and the enclosure top wall 48. The other half of the number of supports 14, for example two supports 14, are arranged in a side-by-side second stack 56 of supports 14. The second table top supports stack 56 is located in the enclosure 40 to the other side of the table top stack 50 from the first table top stack 54 between the table top stack 50 and the other side wall 44B of the enclosure 40 with the legs 18A, 18B, 24A, 24B parallel to the adjacent enclosure side wall 44B and the enclosure end walls 46A, 46B, and in contact with the table top stack 50, the adjacent enclosure side walls 44B, both enclosure end walls 46A, 46B, the enclosure bottom wall 42, and the enclosure top wall 48. Therefore, the table top stack 50 is tightly sandwiched between the first stack 54 of supports and the second stack 56 of supports inside the enclosure 40.

Further, the storage stand 30 is disassembled and also positioned in the enclosure 40. Toward this objective, the storage stand 30 is totally disassembled. That is, the transverse brace members 35A and 35B are detached from the table leg engaging panels 33A and 33B, the vertical support bars 36A and 36B are detached from the table leg engaging panels 33A and 33B, and the transverse handle bar 38 is detached from the support bars 36A and 36B.

with reference to FIGS. 2 and 3, the vertical support bars 36A and 36B and the transverse handle bar 38 can be taped together and are positioned in the enclosure 40 in the space defined between the first leg pair 16, second leg pair 22, one end wall 46A of the enclosure, and the length side edge of the table top stack 50. Resilient material spacers 58 are positioned between the bundle of taped together support bars 36A, 36B and the handle bar 38, and the length side edge of the table top stack 50. The leg engaging panels 33A, 33B are positioned in the space between the legs 18A, 18B and legs 24A, 24B of the closed table bases 14 of one of the table top supports stack 54 at one side of the table top stack 50. Resilient material inserts 60 are positioned between the leg engaging panels 33A, 33B and the adjacent side of the table top stack 50. And, the leg engaging panels 33A, 33B are taped in place to the side of the table top stack 50. The transverse base cross-members 35A, 35B are also positioned in the space between the legs 18A, 18B and legs 24A, 24B of the closed table bases 14 of one of the supports stack 54 at one side of the table top stack 50. Resilient material inserts 62 are positioned between the base cross-member 35A, 35B and the adjacent side of the table top stack 50.

The foregoing description is given primarily for clearness of understanding and no unnecessary limitations are to be understood therefrom for modifications will become obvious to those skilled in the art upon reading this disclosure and may be made without departing from the spirit of the invention or scope of the appended claims.

What is claimed:

1. In a shipping carton including a plurality of folding tables therein, the folding tables having table tops and foldable leg support means, the table tops having a length greater than their width, each leg support means including two pairs of pivotally connected legs, the improvement comprising table tops detached from said leg support means, said table tops being oriented with their length dimension vertically disposed in the carton and sandwiched between at least two folded leg support means, the length dimension of said table tops being in parallel with said pair of legs.

2. The shipping carton of claim 1, having two spaced apart end walls, two spaced apart side walls, and a bottom wall spaced from and parallel to the top wall, the distance between said spaced apart end walls being substantially equal to the width of said leg support means.

3. The shipping carton of claim 2, wherein the distance between said top wall and said bottom wall being substantially equal to the height of said leg support means.

4. The shipping carton of claim 3, wherein the distance between said side walls being substantially equal to the thickness dimension of said sandwiched table tops and said folded leg support means to either side of said sandwiched table tops.

5. The shipping carton of claim 1, further comprising resilient material spacers between adjacent sandwiched table tops.

6. The shipping carton of claim 1, further comprising resilient material spacers between said leg support means and the adjacent one of said sandwiched table tops.

7. The shipping carton of claim 1, wherein the folding tables further include a leg support means support frame including table leg engaging panels and a handle frame structure attachable to said leg engaging panels, said table leg engaging panels being located in the space between the two pairs of pivotally connected legs of said leg support means.

8. The shipping carton of claim 7, further comprising resilient material spacers between said table leg engaging panels and the adjacent one of said sandwiched table tops.

9. The shipping carton of claim 2, wherein the width of said sandwiched table tops is less than the space between the end walls of the carton.

10. The shipping carton of claim 9, wherein the folding tables further include a leg support means support frame including table leg engaging panels and a handle frame structure attachable to said leg engaging panels, said handle frame structure being located in the space between the vertically oriented length edges of said sandwiched table tops and the adjacent wall of the container.

11. The shipping carton of claim 10, further comprising resilient material spacers between said handle frame support structure and the vertically oriented length edges of said sandwiched table tops.

* * * * *